US006258415B1

(12) United States Patent
Troup-Packman

(10) Patent No.: US 6,258,415 B1
(45) Date of Patent: Jul. 10, 2001

(54) IRON-PLATED ALUMINUM ALLOY PARTS AND METHOD FOR PLANTING SAME

(75) Inventor: Sue Troup-Packman, Calabasas, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 08/191,137

(22) Filed: Feb. 3, 1994

Related U.S. Application Data

(63) Continuation of application No. 07/959,881, filed on Oct. 13, 1992, now abandoned.

(51) Int. Cl.[7] ..... B05D 1/18; C23C 2/06; C23C 2/08; C23C 2/12

(52) U.S. Cl. ..... 427/437; 427/438; 427/405; 205/185; 205/187; 205/270; 205/301

(58) Field of Search ..... 427/437, 438, 427/443.1, 306, 405; 205/185, 187, 270, 301

(56) References Cited

U.S. PATENT DOCUMENTS

| | | | | |
|---|---|---|---|---|
| 2,827,399 | * | 3/1958 | Elsenberg | 427/438 |
| 3,202,529 | * | 8/1965 | Dunlap | 427/438 |
| 3,898,098 | * | 8/1975 | Giles | 205/66 |
| 4,194,913 | * | 3/1980 | Davis | 427/437 |
| 4,221,639 | * | 9/1980 | Ninagawa | 205/270 |
| 4,346,128 | * | 8/1982 | Loch | 427/438 |
| 4,545,834 | * | 10/1985 | Shemenski | 156/124 |
| 4,567,066 | * | 1/1986 | Schultz | 427/405 |
| 4,781,799 | * | 11/1988 | Herbert, Jr. et al. | 205/73 |
| 4,808,279 | * | 2/1989 | Moskovits | 205/270 |
| 4,832,800 | * | 5/1989 | Ogata et al. | 205/140 |
| 4,908,280 | * | 3/1990 | Omura et al. | 427/383.9 |
| 5,167,791 | * | 12/1992 | Herbert et al. | 205/67 |
| 5,194,141 | * | 3/1993 | Suganuma | 205/301 |
| 5,368,719 | * | 11/1994 | Troup-Packman | 205/213 |
| 5,397,652 | * | 3/1995 | Carey, II et al. | 428/610 |

FOREIGN PATENT DOCUMENTS

| | | | | |
|---|---|---|---|---|
| 747321 | * | 11/1966 | (CA) | 427/405 |
| 2602335 | * | 7/1976 | (DE) | 427/405 |
| 294 512 | | 2/1991 | (DE) . | |
| 1436855 | * | 5/1976 | (GB) | 427/405 |

OTHER PUBLICATIONS

O.J. Klingenmaker "Hard Iron Plating of Aluminum Pistons" Plating Aug., 1974, pp. 741–746.*

R.H. Williams, "Iron Plating", in *Metal Finishing*, Michael Murphy Ed., pp. 223, 224, 226 (Jan. 1992).

Patent Abstracts of Japan, C section, vol. 11, No. 214, Jul. 10, 1987, The Patent Office Japanese Government (abstract)., 62–30887.

Patent Abstracts of Japan, C section, vol. 12, No. 33, Jan. 30, 1988, The Patent Office of Japanese Government (abstract)., 62–180083.

* cited by examiner

*Primary Examiner*—Marianne Padgett
(74) *Attorney, Agent, or Firm*—V. D. Duraiswamy; M. W. Sales

(57) ABSTRACT

A process for plating aluminum alloy substrates (10), such as 390 aluminum alloy pistons (12), with iron comprises (a) plating on the aluminum substrate a layer of zincate from a zincate bath; (b) plating on the zincate layer a layer (14) of nickel from an electroless nickel bath; (c) plating on the nickel layer a layer (16) of iron from an iron ammonium sulfate bath; and (d) plating on the iron layer a layer (18) of tin from an alkaline tin bath. During the electroless plating, the zincate layer, which protects the underlying aluminum against oxidation, is sacrificed. All of these baths are environmentally much safer than cyanide and chloride. They are also cost effective and can be utilized in a totally closed loop plating system.

10 Claims, 1 Drawing Sheet

IRON-PLATED ALUMINUM ALLOY PARTS AND METHOD FOR PLANTING SAME

This is a continuation application Ser. No. 07/959,881 filed Oct. 13, 1992 now abandoned.

BACKGROUND OF THE INVENTION

1. Field of the Invention

The present invention relates to the plating of aluminum and aluminum alloys, and, more particularly, to the plating of 390 aluminum alloys with iron.

2. Description of Related Art

In the use of aluminum internal combustion engines with aluminum pistons for vehicles, it is essential that either the piston or the cylinder bore be coated with another metal harder than aluminum to prevent piston skirt scuffing during cold starts. Commonly, an iron coating is plated onto the surface of the aluminum pistons, generally employing a copper undercoat.

In one process, copper cyanide and iron chloride baths are used in the plating. Copper cyanide is a highly toxic and tightly regulated material. The iron chloride bath is also a highly toxic and extremely corrosive bath that is very destructive to the equipment around it.

An alternative approach is to insert an iron sleeve into the cylinder bore. Still another approach is to coat the inside of the bore with a suitable metal alloy by thermal spray coating processes and then re-machining the bore. These approaches are estimated to be 8 to 14 times as expensive as piston plating.

It is desired to provide a method, preferably inexpensive, for plating aluminum pistons with an acceptable iron coating that will pass all the required adhesion, hardness, and abrasion tests without using highly toxic or hazardous substances.

SUMMARY OF THE INVENTION

In accordance with the invention, a substitute for cyanide is provided, namely, electroless nickel. The process for plating 390 aluminum alloy substrates with iron comprises:

(a) plating on the aluminum substrate a layer of zincate from a zincate bath;

(b) plating on the zincate layer a layer of nickel from an electroless nickel bath;

(c) plating on the nickel layer a layer of iron from an iron sulfate bath; and (d) plating on the iron layer a layer of tin from an alkaline tin bath.

All of these baths are environmentally much safer than copper cyanide and ferric chloride. They are also cost effective and can be utilized in a totally closed loop plating system.

The resulting iron-plated aluminum alloy parts comprise a first layer of nickel on a surface of the part, a second layer of iron on the first layer of nickel and a third layer of tin on the second layer of iron. The coating evidences good adhesion and wear properties.

BRIEF DESCRIPTION OF THE DRAWINGS

The sole FIGURE is a schematic drawing of the structure of an aluminum piston coated in accordance with the invention.

DESCRIPTION OF THE PREFERRED EMBODIMENTS

Figure 1:
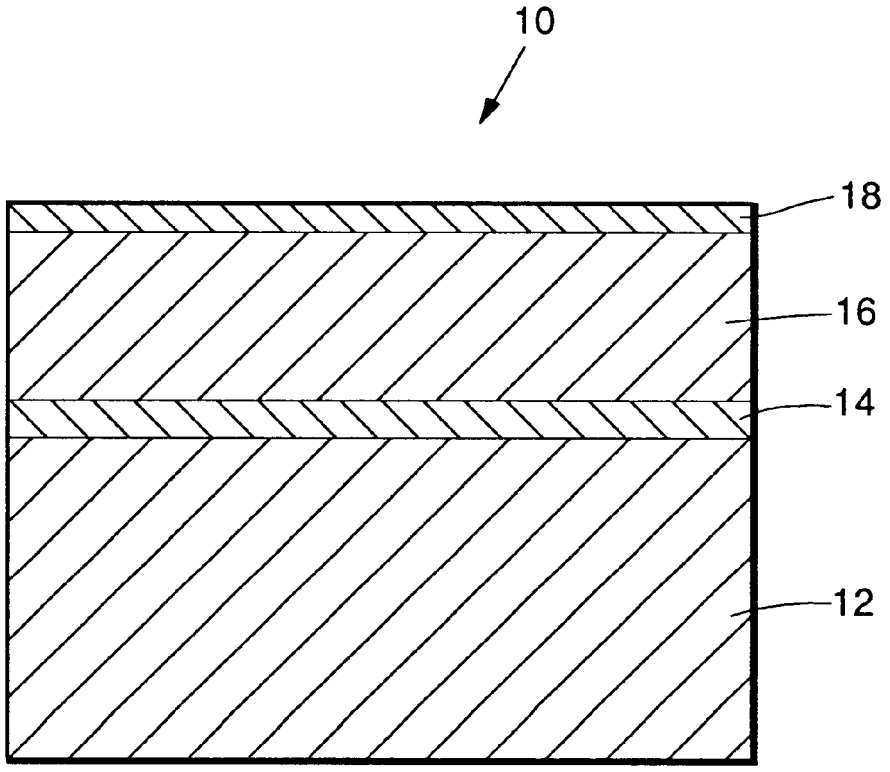

In the process of the invention, the aluminum alloy pistons are first cleaned to remove grease and oils, typically employing a non-etching, hot alkaline cleaner. Examples of such cleaners include commercially available products, such as dishwashing compositions, CHEMIZID 740, an aqueous solution of sodium hydroxide and sodium lauryl sylfate available from Allied-Kelite, and ALKANOX, an acid-based cleaner having a proprietary composition available from VWR Scientific. The immersion time typically ranges from about 15 seconds to 1 minute. If the part is very oily or greasy, a solvent degrease step may be inserted prior to the alkaline cleaning step.

The cleaned parts are then rinsed in cold running water, acid-etched for 10 seconds to remove aluminum oxides, and rinsed again with cold water. A well-known acid etch suitably employed in the practice of the invention for removing aluminum oxides comprises about 50% water, 25% sulfuric acid, 24% nitric acid, and 1% hydrofluoric acid. However, any of the acid etches known for removing aluminum oxides may be employed, such as a solution of ammonium bi-fluoride double salt, commercially available as ARP 28 from Allied Kelite.

The parts are now ready for plating. In the first plating step, the parts are immersed in a zincate bath, such as a proprietary immersion zincate solution comprising an aqueous solution of zinc oxide and sodium hydroxide available from Allied Kelite under the tradename ARP 302 Zincate. The bath is made up according to the manufacturer's directions and is operated at room temperature. Immersion time is typically 30 seconds.

The zincate layer is essentially transitory, and is used to prevent aluminum oxides from reforming after the acid etch step. This layer is lost during the subsequent electroless nickel plating, described in greater detail below.

The zincate-coated parts are rinsed with cold running water and then immersed in an electroless nickel bath, such as a proprietary electroless nickel solution comprising an aqueous solution of nickel sulfate, sodium hypophosphate, and additional proprietary salts available from Allied Kelite under the tradename Electroless Nickel 794. Any of the known electroless nickel solutions may be employed in the practice of the invention. The bath is made up according to the manufacturer's directions and is heated to 185° to 200° F. (85° to 93.3° C.), and preferably about 190° F. (87.8° C.). Immersion time is typically about 5 minutes and results in a thickness of about 0.00005 inch (0.00013 cm). An immersion time of about 1 minute results in a thickness of about 0.000003 inch (0.0000076 cm), which is also useful in the practice of the invention.

The thickness of the nickel coating may range from about 0.000002 to 0.0015 inch (0.000005 to 0.0038 cm) to provide a layer to which the subsequently-plated iron layer will adhere. A nickel thickness less than about 0.000002 inch may not provide sufficient adherence of the iron layer thereto, and a nickel thickness greater than about 0.0015 inch may be too brittle.

The nickel-plated parts are rinsed with cold running water and are next immersed in a novel iron plating bath, the composition of which comprises an aqueous solution of ferrous ammonium sulfate. The concentration of this plating bath ranges from a value of about 250 g/L to 400 g/L. Preferably, the concentration of ferrous ammonium sulfate is about 250 g/L.

The iron plating bath may also include appropriate addition agents, such as wetters, brighteners, and the like, to enhance the plating characteristics. A brightener permits use of higher current densities, which make it possible to plate the part faster. The composition and concentration of such addition agents are well-known in the art and hence do not form a part of this invention.

The anodes are cold rolled or electrolytic iron. A current of about 10 to 75 amps/ft$^2$ (107.6 to 807.3 amps/m$^2$) is impressed on the part, as cathode. Preferably, the current is about 40 to 50 amps/ft$^2$ (430.6 to 538.2 amps/m$^2$), which provides the best combination of fast plating time consistent with good visual appearance of the iron plate.

The iron is plated to a thickness of about 0.0002 to 0.0015 inch (0.00051 to 0.0038 cm). A thickness of less than about 0.0002 inch does not provide a sufficiently thick coating of iron for wear, while a thickness of greater than about 0.0015 inch results in an iron layer that is too brittle. The preferred thickness for aluminum alloy pistons is about 0.001 inch (0.0025 cm) of iron per side.

A typical dwell time of about 20 minutes at 40 amps/ft$^2$ (430.6 amps/m$^2$) is used to obtain the desired thickness, although shorter or longer times at lower or higher currents may be employed in the practice of the invention to obtain the desired thickness.

The iron-plated part is rinsed in cold running water and is finally immersed in a tin plating bath, such as a proprietary alkaline non-brightened tin bath available from M&T Harshaw under the tradename AT 221-B, to form a tin "strike". The tin strike protects the underlying iron layer against rusting.

Tin is plated on to a thickness of about 0.000005 to 0.0001 inch (0.000012 to 0.00025 cm) following the manufacturer's directions. Preferably, a "strike", ranging in thickness from about 0.000007 to 0.000015 inch (0.0000178 to 0.000038 cm) is employed.

The bath is operated at 20 amps/ft$^2$ (215.3 amps/m$^2$). A typical dwell time for the "strike" thickness is about 30 seconds.

The tin-plated part is rinsed in cold running water and, after drying, is ready for assembly into the aluminum engine.

The sole FIGURE is a schematic diagram of an iron-coated aluminum alloy piston 10, comprising a 390 aluminum piston casting 12 onto which electroless-plated nickel layer 14, e.g., about 1 $\mu$m in thickness, is formed. An iron layer 16, e.g., about 25 $\mu$m in thickness, is plated on the nickel layer 14, and a tin "strike" 18, about 0.5 $\mu$m in thickness, is plated on the iron layer 16.

While the invention has been described in terms of plating 390 aluminum alloy pistons, which is a silicon-aluminum alloy containing about 18% silicon, the teachings of the present invention are equally applicable to the iron plating of other aluminum alloys and of other aluminum alloy parts.

Often, a bake step is employed following electroplating of, for example, iron onto an aluminum alloy. Such a baking step is intended to remove hydrogen embrittlement and to improve adhesion of the plated coating. The bake step is typically carried out at an elevated temperature, such as about 350° to 400° F., typically about 375° F., for a period of time, such as about 1 to 3 hours, typically about 1 hour. While other aluminum alloys, such as 6061, may require baking following plating, 390 aluminum alloy does not appear to require such treatment.

It is very important for many applications, such as iron plating of aluminum alloy pistons, that the iron coating have an acceptable hardness. For pistons, this hardness should be equivalent to a Rockwell hardness of about 40 or higher on the C scale. The practice of this invention provides iron coatings of acceptable hardness for such applications.

390 aluminum alloy pistons plated as above have been tested for adhesion, morphology, hardness, and thickness and have passed all tests. Adhesion tests have been run on test coupons. All coupons passed the tape adhesion test. Microscopic examination of cross-sections have shown the morphology of the deposit to be tight and close-grained. The coupons also showed good adhesion in simple abrasion tests.

EXAMPLE

Aluminum alloy coupons were cleaned, prepared with a zincate immersion, and then electroless plated with nickel, employing conventional process parameters.

A series of ferrous ammonium sulfate plating baths were formulated using various concentrations of $Fe(NH_4)_2$—$(SO_4)_2.6H_2O$ as shown in the Table below. Each bath had a 0.1% concentration of Wetter 22, a proprietary surfactant wetter from Udylite. Sodium chloride was added to some, but not all, of the baths as indicated in the Table, and the pH was recorded as also shown in the Table. Coupons of 6061 aluminum and/or 390 aluminum alloy were electroplated at 40 amps/ft$^2$ (430.6 amps/m$^2$) for 20 minutes using an electrolytic iron anode with a 2:1 ratio of anode area to cathode area. The plating bath temperatures are also shown in the Table. The thickness of the coatings was measured with a micrometer, and then nickel or tin was plated on top of the iron coating to prevent corrosion. The coupons were micro-sectioned, the thicknesses were verified with a scanning electron microscope, and the hardness of the iron layer was determined with a Knoop microhardness indenter with a 10 g load. The results are indicated in the Table. The hardness of the iron coatings was appropriate for plated piston applications when the concentration of $Fe(NH_4)_2$ $(SO_4)_2.6H_2O$ was between 250 and 400 g/L and the pH was about 2.7 to 2.9.

Thus, there has been disclosed iron-plated aluminum alloy parts and a process for plating the same. It will be appreciated by those skilled in the art that various changes and modifications of an obvious nature may be made, and all such changes and modifications are considered to fall within the scope of the invention, as defined by the appended claims.

TABLE

Iron Plating Parameters and Results.

| Ferrous Salt Conc'n, g/L | NaCl Conc'n, g/L | Bath pH | Bath Temp., ° C. | Thickness, inches | Rockwell Hardness, C Scale |
|---|---|---|---|---|---|
| 500 | 0 | 3.5 | 49 | 0.0005 | 21 |
| 450 | 0 | 3.2 | 49 | 0.0006 | 25 |
| 400 | 0 | 3.0 | 49 | 0.0008 | 37 |
| 350 | 0 | 2.9 | 49 | 0.0006 | 36 |
| 350 | 50 | 2.8 | 49 | 0.0008 | 37 |
| 300 | 50 | 2.7 | 49 | 0.0010 | 41 |
| 250 | 50 | 2.7 | 49 | 0.0010 | 37 |
| 250 | 50 | 2.7 | 29 | 0.0012 | 47 |
| 200 | 0 | 2.4 | 49 | 0.0004 | 27 |
| 150 | 0 | 2.0 | 49 | 0.0002 | 19 |
| 100 | 0 | 1.7 | 49 | no deposit | — |

What is claimed is:

1. A process for plating aluminum alloy substrates with iron consisting of the following steps, each step followed by a water rinse:

(a) treating said aluminum substrate with a zincate bath to deposit an immersion layer of zinc metal thereon;

(b) plating on said zincate-treated aluminum surface a layer of nickel from an electroless nickel bath;

(c) electroplating on said nickel layer a layer of iron from an iron sulfate bath; and (d) electroplating on said iron layer a layer of tin from an alkaline tin bath, wherein said electroless nickel bath supersedes a copper cyanide bath and said iron sulfate bath supersedes an iron chloride bath, said electroless nickel bath and said iron sulfate bath as a first combination being substantially less toxic than said copper cyanide bath and said iron chloride bath as a second combination.

2. The process of claim 1 wherein said layer of nickel is plated to a thickness ranging from about 0.000002 to 0.0015 inch.

3. The process of claim 2 wherein said layer of nickel is plated to a thickness ranging from about 0.000003 to 0.00005 inch.

4. The process of claim 1 wherein said layer of iron is plated to a thickness ranging from about 0.00002 to 0.0015 inch.

5. The process of claim 4 wherein said layer of iron is plated to a thickness of about 0.001 inch.

6. The process of claim 1 wherein said layer of tin is plated to a thickness ranging from about 0.000005 to 0.001 inch.

7. The process of claim 6 wherein said layer of tin is plated to a thickness ranging from about 0.000007 to 0.000015 inch.

8. The process of claim 1 wherein said nickel is plated from an electroless nickel plating bath.

9. The process of claim 1 wherein said iron is plated from an iron plating bath comprising an aqueous solution of ferrous ammonium sulfate.

10. The process of claim 9 wherein said plating bath comprises an aqueous solution of about 250 to 400 g/L of iron ammonium sulfate maintained at a pH of about 2.0 to 2.9.

* * * * *